US009701507B2

(12) United States Patent
Rauscher

(10) Patent No.: US 9,701,507 B2
(45) Date of Patent: Jul. 11, 2017

(54) METHOD AND DEVICE FOR THE PRODUCTION OF A NUMBER OF COILED FOIL ROLLS

(71) Applicant: SML Maschinengesellschaft m. b. H., Lenzing (AT)

(72) Inventor: Thomas Rauscher, Berg im Attergau (AT)

(73) Assignee: SML MASCHINENGESELLSCHAFT M. B. H., Lenzing (AT)

( * ) Notice: Subject to any disclaimer, the term of this patent is extended or adjusted under 35 U.S.C. 154(b) by 113 days.

(21) Appl. No.: 14/699,267

(22) Filed: Apr. 29, 2015

(65) Prior Publication Data

US 2015/0321868 A1 Nov. 12, 2015

(30) Foreign Application Priority Data

May 10, 2014 (DE) ..... 10 2014 006 933

(51) Int. Cl.

| | |
|---|---|
| ***B65H 35/06*** | (2006.01) |
| ***B65H 18/08*** | (2006.01) |
| ***B31F 1/00*** | (2006.01) |
| ***B65H 23/032*** | (2006.01) |
| ***B65H 35/02*** | (2006.01) |

(Continued)

(52) U.S. Cl.

CPC ..... *B65H 35/06* (2013.01); *B26D 1/095* (2013.01); *B31F 1/0016* (2013.01); *B65H 18/08* (2013.01); *B65H 23/032* (2013.01); *B65H 35/02* (2013.01); *B65H 45/22* (2013.01); *B65H 2301/3612* (2013.01); *B65H 2301/41486* (2013.01); *B65H 2301/414322* (2013.01); *B65H 2301/45* (2013.01); *B65H 2701/11234* (2013.01);

(Continued)

(58) Field of Classification Search

CPC ..... B65H 35/06; B65H 45/22; B65H 45/28; B65H 2301/45; B65H 2701/11234

See application file for complete search history.

(56) References Cited

U.S. PATENT DOCUMENTS

| | | | |
|---|---|---|---|
| 3,536,273 | A | 10/1970 | Hawkins |
| 3,801,036 | A | 4/1974 | Hasler |

(Continued)

FOREIGN PATENT DOCUMENTS

| | | | |
|---|---|---|---|
| DE | 60015903 | T2 | 3/2005 |
| EP | 0638505 | B2 | 2/1995 |

(Continued)

OTHER PUBLICATIONS

European Search Report dated Nov. 6, 2015.

*Primary Examiner* — Sang Kim

(74) *Attorney, Agent, or Firm* — Lucas & Mercanti, LLP

(57) ABSTRACT

The coiled foil rolls are reinforced in their edge region by folding. The coiled foil rolls are made by supplying a foil to coiling devices; cutting the foil in a conveying direction with a knife so that at least two foil sections are created which extend in a conveying direction; folding the edge regions of the foil sections by a folding device and laying the folded sections and the remaining part of the foil section on each other; and coiling the foil sections with the coiling devices. The knife or the folding device are moved simultaneous oscillating back and forth in a direction transversal to the conveying direction during the coiling of the foil sections.

11 Claims, 7 Drawing Sheets

(51) Int. Cl.
*B65H 45/22* (2006.01)
*B26D 1/09* (2006.01)

(52) U.S. Cl.
CPC ..... *B65H 2701/1315* (2013.01); *B65H 2701/1752* (2013.01)

(56) References Cited

U.S. PATENT DOCUMENTS 4,526,567 A * 7/1985 Yokoe ..... A44B 19/34 493/381
5,246,416 A * 9/1993 Demura ..... B31B 19/36 493/439
5,520,872 A * 5/1996 Scherer ..... B65H 45/22 264/285
5,531,393 A 7/1996 Salzsauler
5,565,222 A * 10/1996 Scherer ..... B65H 45/22 156/202
5,967,437 A 10/1999 Martin-Cocher et al.
6,394,330 B1 * 5/2002 Jackson ..... A45F 5/02 224/249
6,592,699 B1 * 7/2003 Mehta ..... B29C 53/36 156/227
8,053,056 B2 * 11/2011 Heikaus ..... B29C 66/4722 156/253
8,100,356 B2 1/2012 Pirtle et al.
8,221,298 B2 7/2012 Pirtle et al.
8,475,349 B2 * 7/2013 Pirtle ..... B65H 18/10 493/356
8,777,829 B2 * 7/2014 Pirtle ..... B65H 18/10 493/360
2003/0189118 A1 * 10/2003 Smith ..... B65H 18/28 242/160.4
2010/0012764 A1 1/2010 Pirtle

FOREIGN PATENT DOCUMENTS

EP 0878425 B2 11/1998
WO 2015055726 4/2015

* cited by examiner

METHOD AND DEVICE FOR THE PRODUCTION OF A NUMBER OF COILED FOIL ROLLS

CROSS-REFERENCE TO RELATED APPLICATIONS

The present application claims priority of 10 2014 006 933.8, filed May 10, 2014, the priority of this application is hereby claimed and this application is incorporated herein by reference.

BACKGROUND OF THE INVENTION

The invention relates to a method for the production of a number of coiled foil rolls, wherein the foils are reinforced in their edge region by folding. Furthermore, the invention relates to a device for the production of a number of coiled foil rolls.

It is a known solution at the production and coiling of plastic foils that the plastic foil which comes from a foil producing device, for example an extruder, is delivered to a spooling device to prepare it for the further handling and especially for the transport.

Thereby, it is known for example from DE 600 15 903 T2 or from EP 0 638 505 B1 to carry out the coiling in such a manner that during coiling the lateral end regions of the foil are crimped over. By doing so it can be reached that the sensitive lateral regions of the foil are much more mechanical stable as it would be in the case of a not crimped foil.

To make sure that the coiled foil with crimped lateral region becomes not too thick in the two lateral regions it is furthermore known to superpose the coiling device an oscillating transversal movement during the coiling process (changing of the spooling device). Such a solution is shown for example in EP 0 878 425 B1.

Furthermore, it is also known to cut several lamellar partial foils (foil section or "use") from a delivered foil which extends along a whole width, wherein the single foil sections are then coiled respectively. This is disclosed for example in U.S. Pat. No. 8,221,298 B2.

Further solutions concerning the mentioned process are shown in U.S. Pat. No. 8,100,356 B2 and U.S. Pat. No. 5,531,393.

It is detrimental at some of the pre-known solutions that it is not possible to flexibly cut and coil several partial uses, i.e. foil sections, directly in an inline process, i.e. coming from the extruder. Rather, it is provided here that the coiling takes place in a subsequent process (i.e. offline). Insofar, methods and devices are concerned here which are basing only on a foil which is cut as a "single use".

If the edges are reinforced, i.e. doubled and crimped over respectively, a thickening in the lateral regions occur ("bone") as already mentioned, because the foil is doubled in terms of thickness in the region of the crimping and here becomes thick correspondingly. So, disadvantages result also at the further processing like increased outer dimensions of the coiled foil which is detrimental with respect for example to the volume of the packaging, to a blocking of the foil and to a higher pressure onto the coiling sleeve respectively. To allow a better coiling of the edges a second subsequent process for the oscillation of the foil is normally necessary.

It is common in all pre-known solutions that the width of the foil sections can be changed only in a difficult way or cannot be changed at all. Furthermore, it is hardly possible to change the extent of the edge reinforcement, i.e. of the folded region.

SUMMARY OF THE INVENTION

Thus, it is an object of the invention to create a method of the kind mentioned above and a respective device by which it is possible to coil up foil sections with an arbitrary width in a very flexible manner and in an economic way. Especially, a compact coil should be provided directly from the foil production process which is characterized by an easy possibility of adjustment of the width of the foil section ("use") as well as for the extent of the folding of the foil in the lateral edge section. So, it should become possible to operate the process directly from the production process of the foil, i.e. inline, with several partial uses in any adjustment.

The solution of this object by the invention is characterized in that the method comprises the steps of:

a) Supplying of a foil which extends along a total width in a conveying direction to a number of coiling devices (or wrapping devices);

b) Cutting of the foil in conveying direction by means of at least one knife, so that at least two foil sections ("uses") are created which extend in conveying direction;

c) Folding of at least a number of the edge regions of the foil sections, which are created by the cut with a knife, by means of at least one folding device and laying about each other of the folded sections and of the non-folded remaining part of the foil section;

d) Coiling of each foil section on one or more coiling devices (or wrapping devices);

wherein the at least one knife and the at least one folding device are moved simultaneous oscillating back and forth relatively to the coiling devices (or wrapping devices) in a direction transversal to the conveying direction during the coiling of the foil sections on the coiling devices (or wrapping devices) to coil the foil sections due to the oscillating movement with a changing axial offset on the coiling devices.

The folding according to step c) takes place preferably in such a manner that the folding device folds the lateral end sections of two foil sections which are located adjacent to another by means of two adjacent folding elements. For the folding of respectively two adjacent foil sections especially the subsequently mentioned rolls and centre cones are also employed.

The device for the production of a number of coiled foil rolls, wherein the foils are reinforced in its edge region by folding, comprises according to the invention:

- a supplying device for supplying of a foil which extends along a total width in a conveying direction and a number of coiling devices (or wrapping devices),
- at least one knife for cutting of the foil along the conveying direction,
- at least one folding device for folding of at least a number of the edge regions of the foil sections, which are created by the cut with a knife, and for laying the folded sections and the non-folded remaining part of the foil section about each other,
- an oscillation drive which is designed to move oscillatory the at least one knife as well as the at least one folding device in a direction transversal to the conveying direction, wherein synchronisation means are arranged to synchronize the oscillation movement of the at least one knife and of the at least one folding device.

At least a number of the provided folding devices comprise preferably two adjacent folding elements, which folding elements can fold two adjacent lateral regions of two foil sections which are arranged side by side. Preferably, in this case it can be provided that the two folding elements form, seen in a direction which is perpendicular to the conveying direction and perpendicular to the direction transversal to the conveying direction, a V-shaped contact region for two adjacent lateral regions of two foil sections which are arranged side by side, wherein the angle of the V-shaped structure is between 5° and 60°.

The synchronisation means are preferably realized by a pin which is arranged at the folding device which pin engages in a recess in the oscillation drive. Thereby, a roll can be assigned to each folding element by which the foil is guided which has to be folded. Thereby, the axes of the rolls include preferably an angle to the direction transversal to the conveying direction, wherein the angle is preferably between 1° and 30°. The two folding elements, the two rolls and the pin of the synchronisation means as well as preferably a centre cone are preferably arranged on a common carrier plate. The carrier plate is thereby preferably arranged pivotable around an axis which axis is parallel to the direction transversal to the conveying direction, wherein especially an actuator is arranged for carrying out the pivoting.

Accordingly, the present idea provides a possibility to cut a foil "inline" to a desired width of use, i.e. several foil sections ("uses") can be produced and coiled beneficially in a desired width in one work process.

The proposed concept allows to reinforce the edges of the foil and the foil regions respectively by flapping the edge to the inner side or to the outside.

Thereby the folding device can move transversal to the production direction (conveying direction of the foil) oscillatory forth and back to offset the reinforced edge regions for the coiling process and so to obtain a lesser buildup in the lateral region of the foil roll. By the movement forth and back of the whole unit consisting of folding device and knife the foil is not exposed to any change of the angle. Thereby, the foil is stressed in a lesser manner and the coiling result is substantially more stable as at pre-known solutions.

Accordingly, it is an essential aspect of the present invention that at several "partial uses" of the foil a synchronisation between the knife and the folding device occurs, i.e. both of those device groups move oscillatory relatively to the foil and the coiling devices respectively in the transversal direction to the conveying direction.

Accordingly,—if the coiling device is defined as a (stationary) reference system—the knives of the longitudinal cut of the foil for the single partial uses and the whole device for the reinforcement of the edges (i.e. the folding devices) move in transversal direction of the foil relatively to this reference system. The knife as well as the folding devices move accordingly synchronized relatively to the coiling devices.

At all pre-known systems the partial use itself is moved and the folding device is stationary or the partial use cut (knife) and the deflection (folding device) are stationary and the foil is moved in transversal direction and oscillated respectively with a subsequent device or the folding device is stationary and the partial use cut (knife) moves relatively to the coiling device.

For the synchronization of the movement of the partial use longitudinal cut (knife) and folding rolls (folding device) a plurality of possibilities is given. Each of those units can be moved forth and back for example by means of an own motor. The speed of those motors can be synchronized electronically.

However, a specifically simple and economic solution is that the knifes and the folding device are coupled by means of a driving pin and by a separated connection respectively and so both can be changed (moved transversally) by a single drive unit.

Accordingly the following advantages are obtained by the proposed solution:

The device can be swivelled inward and outward during the normal standard production without the necessity that the whole device is turned off. Thereby, it can be produced with or without reinforced (folded) edges without any production stop.

It becomes possible to change the final width of the product and partial use width respectively (i.e. the width of the foil sections) inline and without stop of the extrusion apparatus. That is, the proposed method allows to produce inline end products (foil sections) with different widths.

Furthermore, is becomes possible to change the reinforcement, i.e. the magnitude of the folded region of the foil, in an easy and flexible manner.

Furthermore, it is possible to cut out a foil strip (middle cut) to change the dimension (i.e. the width) of the reinforcement (folding).

Each folding device can be moved forth and back individually or all present folding devices can be moved together to offset the reinforced edges for the coiling process. Thereby, a variable adjustment can be carried out.

The reinforced edges increase the robustness and use of the finished product. For example, the roll can occasionally fall down on the floor and can nevertheless be used again. Furthermore, the mechanical properties of the foil are improved by the edge reinforcement. Thus, possibly lesser foil is required as in the case of non-folded foil. Normally, the foil rips at first at the edge at a usual foil. This is largely prevented by the reinforcement (folding).

Thus, a soft end product results which can be coiled off from the roll very good.

The various features of novelty which characterize the invention are pointed out with particularity in the claims annexed to and forming a part of the disclosure. For a better understanding of the invention, its operating advantages, specific objects attained by its use, reference should be had to the drawings and descriptive matter in which there are illustrated and described preferred embodiments of the invention.

DETAILED DESCRIPTION OF THE INVENTION

Figure 1:
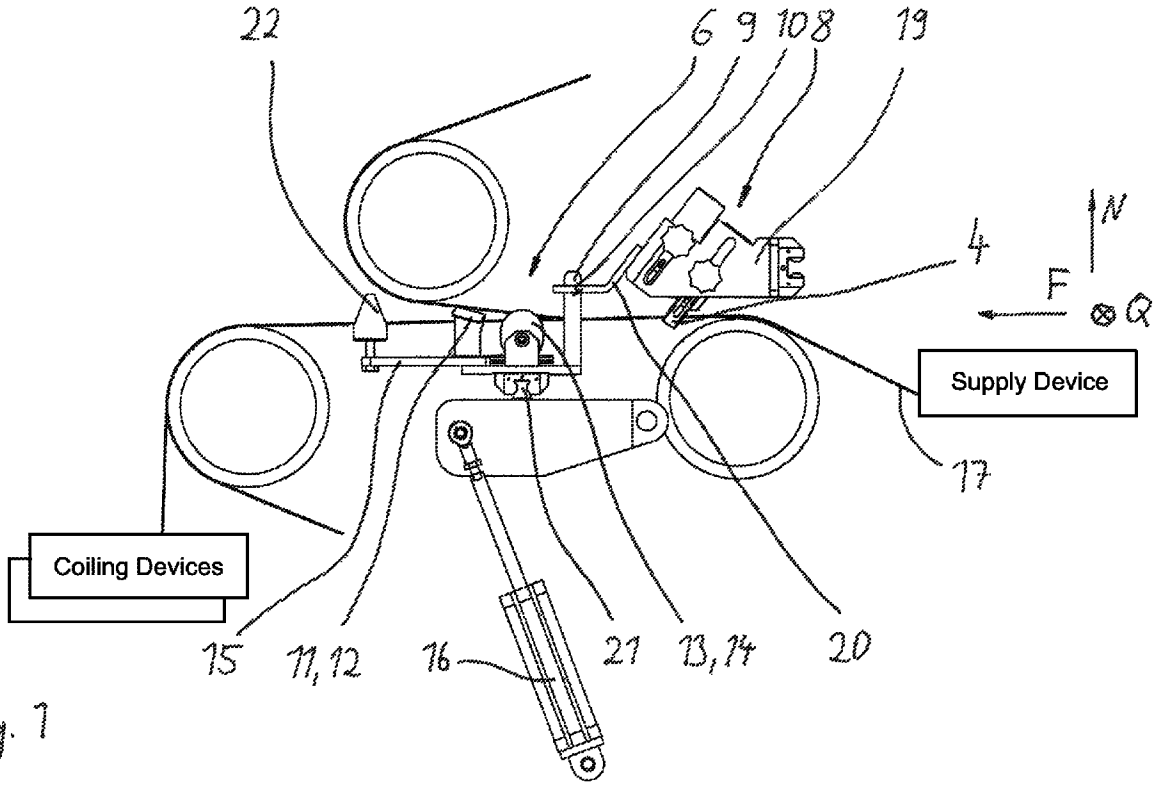
FIG. 1 shows the side view of a device for the production of a number of coiled foil rolls which are cut out from a foil sheet and which are coiled after reinforcement of the edges by folding (turn over), wherein the operation position is shown.
Figure 2:
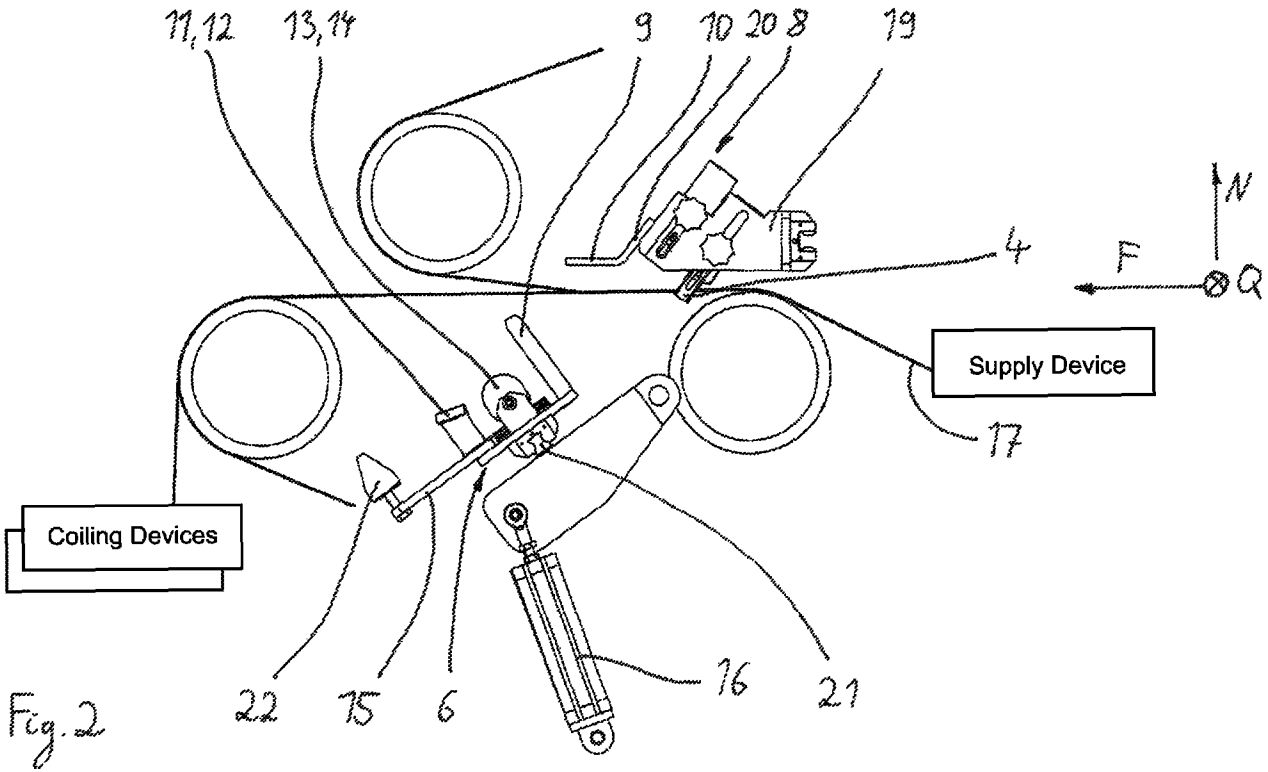
FIG. 2 shows the depiction according to FIG. 1, wherein a position is shown in which a folding device is not in operation.
Figure 3:
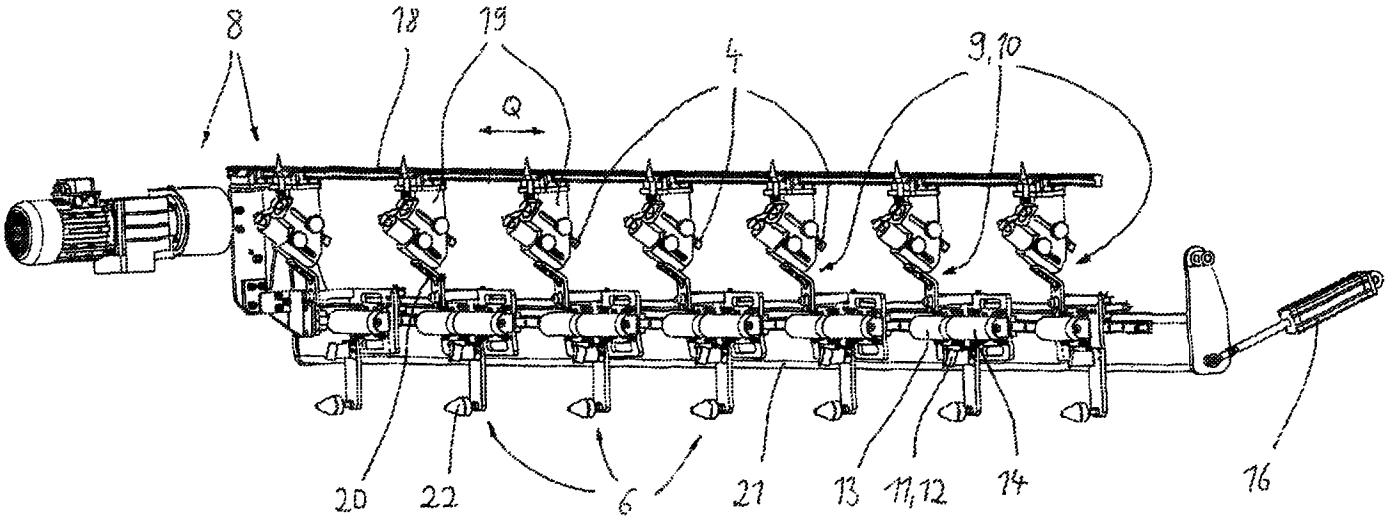
FIG. 3 shows in perspective view the device for the production of a number of coiled foil rolls.

In FIG. 1 and FIG. 2 a device for the production of a number of coiled foil rolls can be seen, wherein the foil rolls are produced by respectively cutting out and coiling a foil section with defined width from a foil sheet with a total width. A not depicted feeding device for the foil 17 is arranged upstream of the depicted device in conveying direction F of the foil 17, for example an output of an extruder in which the foil 17 is produced. Downstream of the depicted device a plurality of (not depicted) coiling devices for coiling of the foil sections ("uses") is arranged. Thereby, it can be provided, which is preferred, that several foil sections are coiled on the same coiling device. Thereby, the feeding device as well as the coiling devices as such are well known in the art, wherein explicitly reference is made to the above mentioned state of the art.

Rather, the arrangement as shown in FIGS. 1 and 2 is essential for the invention. Their detailed design becomes apparent especially from the synopsis with the further FIGS. 3 to 6.

Figure 7:
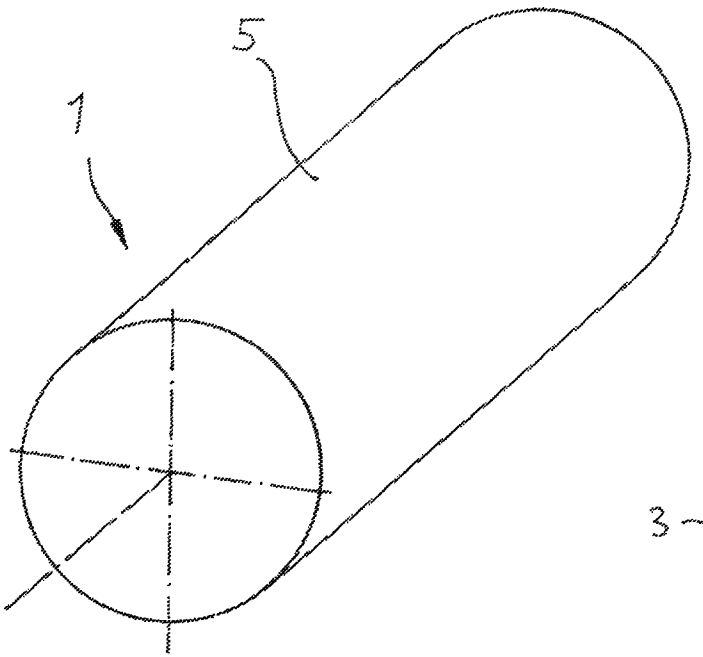
FIG. 7 shows schematically a coiled foil roll and FIG. 8 shows the section through the edges region of the coiled foil.
Figure 8:
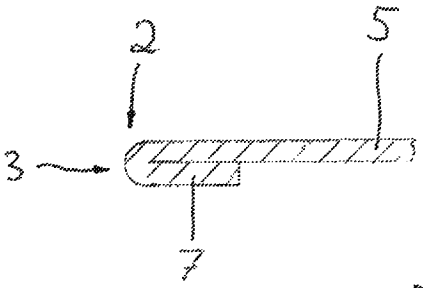

In the FIGS. 7 and 8 a finished foil roll 1 can be seen. This roll is a coiled foil section 5 which was cut out and then coiled from a wider fed foil with a total width. It should be mentioned and it can be seen in FIG. 8 that the foil section 5 which is coiled to the foil roll 1 comprises in its both edge regions 2 a folding 3, i.e. a folded section 7 is folded by 180° and laid along the rest of the foil section. By this folding 3 a significant higher mechanical stability of the edge region of the foil results as well as an insensibility of the edge region during unwinding of the roll also with respect to mechanical damages (if the roll occasionally falls down on the floor).

At the production of the foil rolls 1 with lateral folding 3 it is now proceeded in such a manner that at first the foil, which extends along a total width, is conveyed (from the extruder) in conveying direction F and finally reaches the coiling devices. The device as shown in FIG. 1 is arranged between the conveying device and the coiling devices.

The conveyed foil is then cut into "uses", i.e. a cutting of the foil in conveying direction F occurs by means of a plurality of knifes 4 so that several foil sections 5 are created which extend in conveying direction F.

Subsequently, the folding of the edge regions 2 of the foil sections 5 take place by means of a plurality of folding devices 6. A single one of those folding devices is shown more detailed in the FIGS. 5 and 6. By them a laying one upon the other of the folded sections 7 and of the remaining part of the foil section 5 takes place.

Finally—this is not depicted any more—a coiling occurs of each of the foil sections 5 at one or more coiling devices which are known as such (see for details the above mentioned state of the art).

Thereby, it is essential that the knifes 4 and the folding devices 6 are moved simultaneously oscillated forth and back in a direction transversal Q to the conveying direction F relatively to the coiling devices during the coiling of the foil sections 5 on the coiling devices. For doing so an oscillation drive 8 is arranged.

Figure 5:
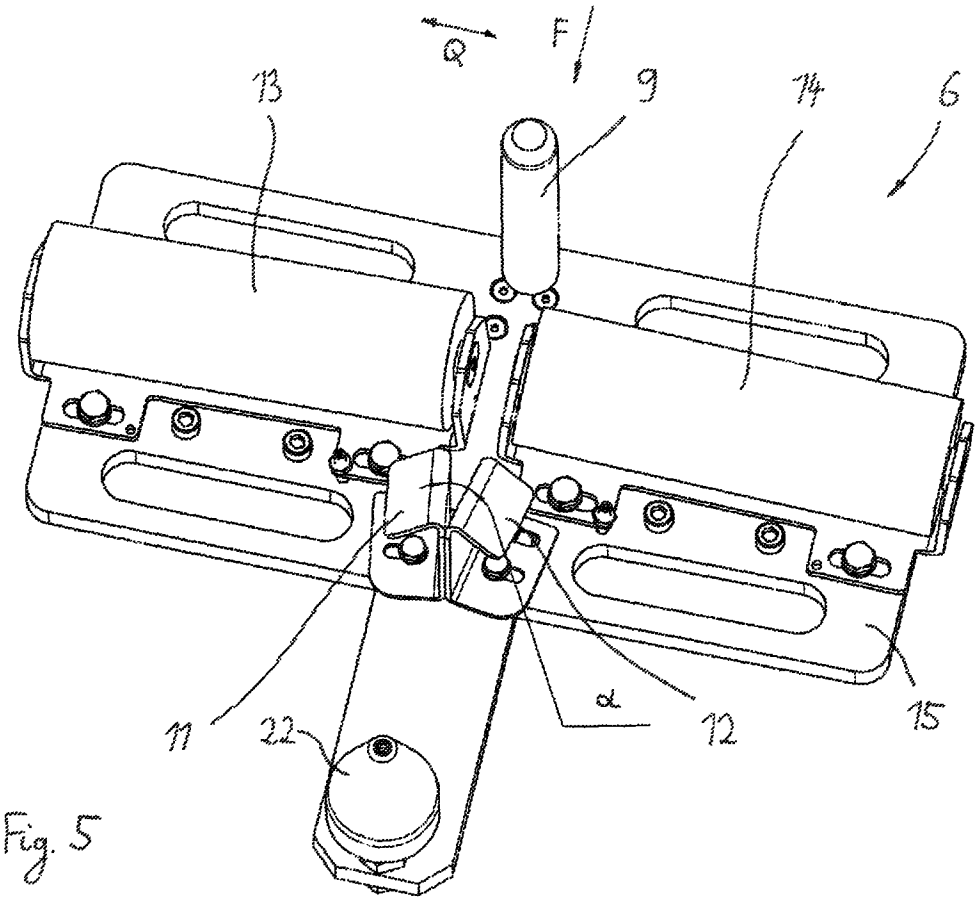
FIG. 5 shows in perspective view a folding device for folding of the edge regions of two adjacent foil sections.

As it can be seen best from FIG. 5 the folding occurs in such a manner that the folding device 6 folds the lateral end sections of two adjacent arranged foil sections 5 by means of every two adjacent folding elements 11 and 12, wherein the folding is supported and stabilized also by the rolls 13, 14 and a centre cone 22. Thus, the foil section 5 is at first cut by the knife 4 and pre-oriented by 90° at the rolls 13, 14. By means of the folding elements 11, 12 the flapping of the foil edges occurs in the respective direction, wherein then a further fixation occurs by means of the centre cone 22 as well as a stabilisation of the subsequent coiling.

The foil section 5 which is to be folded in the edge regions is thus pre-oriented for the folding by means of the rolls 13, 14 (bending by about 90°), wherein the folding elements 11, 12 which follow in conveying direction F finalise the folding (by 180°). The centre cone 22 locates the reinforced edge and stabilises the folded foil section; furthermore, the centre cone 22 guides the folded foil section 5 to the coiling device.

Figure 6:
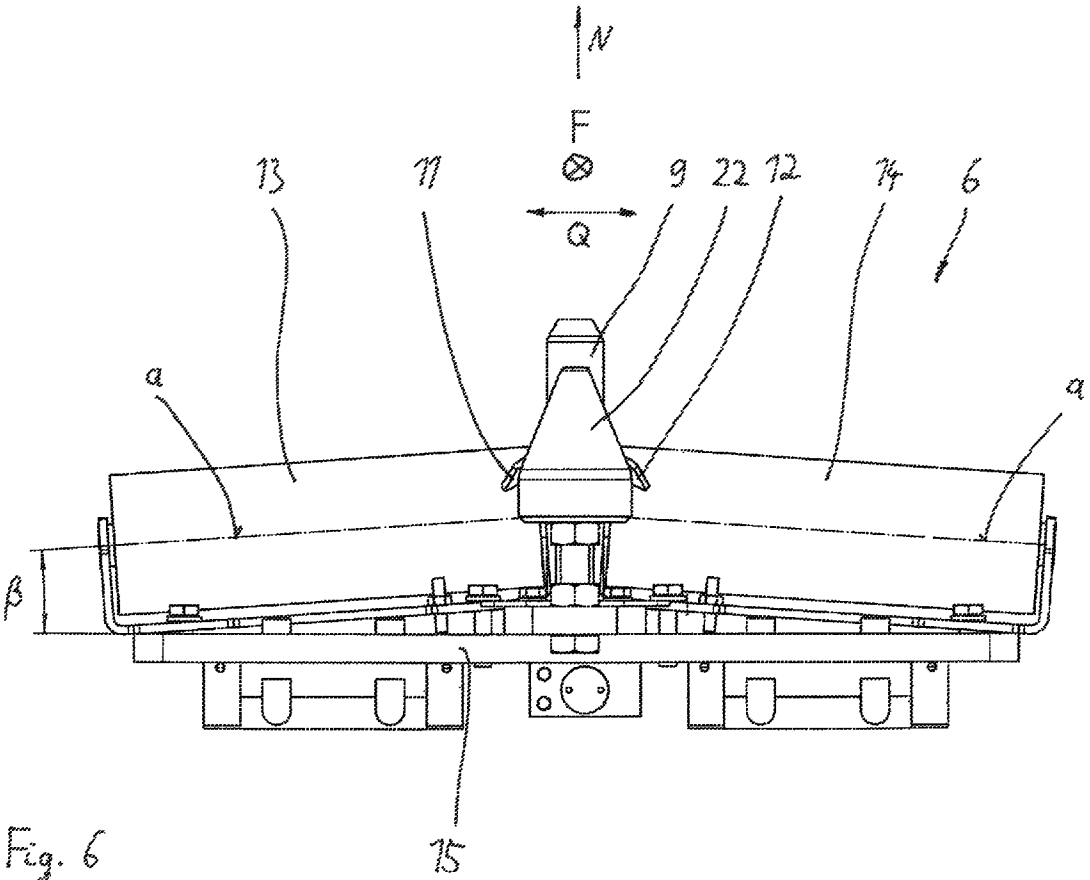
FIG. 6 shows the folding device according to FIG. 5, seen against the conveying direction of the conveyed foil sheet.

With respect to the structure of the proposed device reference is made at first to FIGS. 5 and 6. Two rolls 13 and 14 are arranged on a carrier plate 15 symmetrically to a centre plane. Each of the rolls 13, 14 have an axis a which includes a small angle $\beta$ to the direction Q transverse to the conveying direction F. This angle can be seen in FIG. 6 and is mostly between 1° and 30°.

The conveying direction F lies in this centre plane. The two folding elements 11 and 12 are also arranged symmetrically in the mentioned centre plane. When the two folding elements 11, 12 are regarded in a direction N, which is perpendicular to the conveying direction F and which is perpendicular to a direction Q transverse to the conveying direction, which each consist of a bent sheet metal which is screwed on the carrier plate 15, a V-shaped contour of the folding edges of the folding elements 11, 12 becomes visible. The angle $\alpha$ is denoted in FIG. 5; it is preferably between 15° and 40°.

Also, the centre cone 22 is arranged on the carrier plate via a holding arm, which centre cone is arranged in the centre plane and which locates and stabilises again the edges of the folded and running out foil sections 5.

It was already said that it is a significant aspect of the invention that during the coiling of the foil sections 5 in the (not depicted) coiling devices the knifes 4 as well as also the folding device 6 are moved simultaneously oscillatory forth and back in direction Q transverse to the conveying direction F relatively to the coiling devices. For doing so synchronisation means 9, 10, 20 are provided between the knifes 4 and the devices which carry the same respectively and the folding devices 6. Those synchronisation means consist in the embodiment according to FIGS. 1, 2, 3, 5 and 6 of a pin 9 which is fixed on the carrier plate 15 and a connection part 20 which is connected with the knife 4. The carrier plates 15 are connected by means of the rail 9' with the oscillation drive 8. The pin 9 engages in recesses 10 of the connection parts 20 which are arranged on the knifes 4. This becomes apparent in the synopsis of FIGS. 1 and 3. Here can be seen that the oscillation drive 8 comprises a motor which drives a rail 9' extending in the direction Q in an oscillating manner; the carrier plates 15 are arranged on the rail 9'. The pins 9 engage in the recesses 10 of the connection parts 20 which are arranged on the knifes 4. By the engagement of the pins 9 in the recesses 10 in the connection part 20 the synchronization with the knifes is established.

Figure 4:
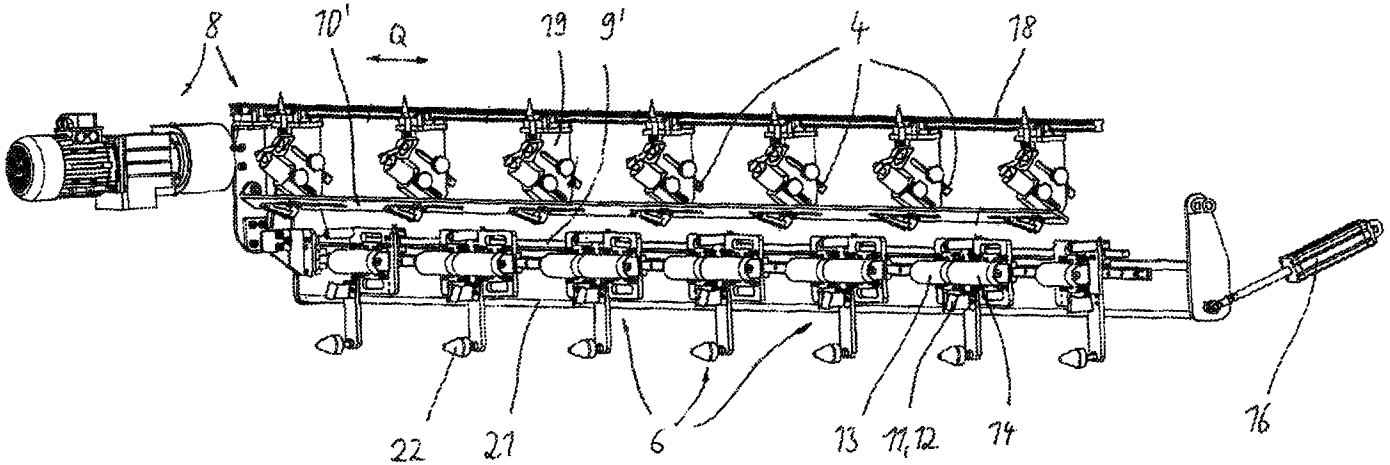
FIG. 4 shows the depiction according to FIG. 3, wherein the coupling of the folding devices with an oscillation drive is realised in a different manner as in FIG. 3.

In the embodiment according to FIG. 4 the synchronization means 9, 10, 20 are designed a bit different. Here a connection rail 10' is provided which extends transversally to the conveying direction F and which is connected with all knifes 4. The connection rail 10' establishes a coupling with the oscillation drive 8. The carrier plate 15 of the folding device 6 is connected with the rail 9'. The rail 9' is also coupled with the oscillation drive 8. Accordingly, an oscillation of the folding devices is established here in the same manner in coupling with the knifes 4, transversally to the conveying direction F.

As can be seen furthermore from the FIGS. 1 to 4 an actuator 16 is provided by which all folding devices 6 which are fixed on a carrier element 21 can be swivelled in engagement or out of engagement. In FIG. 1 the folding devices 6 are in operation, in FIG. 2 they are swivelled in a non-operation position.

While specific embodiments of the invention have been shown and described in detail to illustrate the inventive principles, it will be understood that the invention may be embodied otherwise without departing from such principles.

I claim:

1. A method for the production of a number of coiled foil rolls, wherein the foils are reinforced in both edge regions by folding, wherein the method comprises the steps of:

a) supplying of a foil which extends along a total width in a conveying direction to a plurality of coiling devices;

b) cutting of the foil in the conveying direction by means of at least one knife, so that at least two foil sections are created which extend in the conveying direction;

c) folding of the edge regions of the foil sections by means of at least one folding device to form folded sections, and laying the folded sections and the remaining part of a respective foil section upon each other to form folded edge regions;

d) coiling of each of the at least two foil sections on one or more of the plurality of coiling devices;

wherein the at least one knife and the at least one folding device are moved simultaneous oscillating back and forth in a direction transversal to the conveying direction during the coiling of the foil sections on the one or more of the plurality of coiling devices.

2. The method according to claim 1, wherein the folding according to step c) includes folding, by the folding device, the lateral end sections of two foil sections which are located adjacent to another by means of two adjacent folding elements.

3. A device for the production of a number of coiled foil rolls, wherein the foils are reinforced in both edge regions by folding, and for carrying out the method according to claim 1, wherein the device comprises:

a supplying device for supplying of a foil which extends along a total width in a conveying direction and a plurality of coiling devices, at least one knife for cutting of the foil along the conveying direction, at least one folding device for folding of the edge regions of the foil sections to form folded sections and for laying the folded sections and the remaining part of the foil section upon each other to form folded edge regions, an oscillation drive which is designed to move oscillating the at least one knife and the at least one folding device in a direction transversal to the conveying direction, wherein synchronisation means are arranged to synchronize the oscillation movement of the at least one knife and of the at least one folding device.

4. The device according to claim 3, wherein the at least one folding device comprises two adjacent folding elements, which folding elements can fold two adjacent lateral regions of two foil sections which are arranged side by side.

5. The device according to claim 4, wherein the two folding elements form, in a direction which is perpendicular to the conveying direction and perpendicular to the direction transversal to the conveying direction, a V-shaped contact region for two adjacent lateral regions of two foil sections which are arranged side by side, wherein the angle ($\alpha$) of the V-shaped structure is between 5° and 60°.

6. The device according to claim 4, wherein a roll is assigned to each folding element by which the foil is guided which has to be folded.

7. The device according to claim 6, wherein the axes (a) of the rolls include an angle ($\beta$) to the direction transversal to the conveying direction, wherein the angle ($\beta$) is between 1° and 30°.

8. The device according to claim 4, wherein the synchronisation means comprise a pin which is arranged at the folding device, which pin engages in a recess in the oscillation drive, a roll is assigned to each folding element by which the foil is guided which has to be folded, and the two folding elements, the two rolls and the pin of the synchronisation means are arranged on a common carrier plate.

9. The device according to claim 8, wherein the carrier plate is arranged pivotable around an axis which axis is parallel to the direction transversal to the conveying direction, and the device further comprises an actuator arranged for carrying out the pivoting.

10. The device according to claim 8, further comprising a centre cone arranged on the common carrier plate and configured to locate and stabilize the folded edge regions.

11. The device according to claim 3, wherein the synchronisation means comprise a pin which is arranged at the folding device, which pin engages in a recess in the oscillation drive.

* * * * *